US009568175B2

(12) United States Patent
Johnson

(10) Patent No.: US 9,568,175 B2
(45) Date of Patent: Feb. 14, 2017

(54) SPOTLIGHT WITH WIND SHROUD

(71) Applicant: Keith Norman Johnson, Conway, SC (US)

(72) Inventor: Keith Norman Johnson, Conway, SC (US)

( * ) Notice: Subject to any disclaimer, the term of this patent is extended or adjusted under 35 U.S.C. 154(b) by 0 days.

(21) Appl. No.: 14/182,063

(22) Filed: Feb. 17, 2014

(65) Prior Publication Data

US 2014/0313701 A1 Oct. 23, 2014

Related U.S. Application Data

(60) Provisional application No. 61/766,018, filed on Feb. 18, 2013.

(51) Int. Cl.

| | |
|---|---|
| ***F21L 4/00*** | (2006.01) |
| ***F21V 21/40*** | (2006.01) |
| ***F21L 4/04*** | (2006.01) |
| *F21Y 101/00* | (2016.01) |

(52) U.S. Cl.

CPC ..... *F21V 21/406* (2013.01); *F21L 4/04* (2013.01); *F21Y 2101/00* (2013.01)

(58) Field of Classification Search

CPC ..... A45B 3/04; A45B 3/02; A63C 11/222

See application file for complete search history.

(56) References Cited

U.S. PATENT DOCUMENTS

| | | | | |
|---|---|---|---|---|
| 2,258,531 | A * | 10/1941 | Baldwin | 446/7 |
| 3,266,014 | A * | 8/1966 | Leotta | 340/815.77 |
| 4,962,779 | A * | 10/1990 | Meng | 135/16 |
| 6,367,943 | B1 * | 4/2002 | Tocci et al. | 362/103 |
| 6,526,863 | B2 * | 3/2003 | Torres | 89/36.05 |
| 2004/0211369 | A1 * | 10/2004 | Wechsler | 119/707 |

* cited by examiner

*Primary Examiner* — Peggy Neils
*Assistant Examiner* — Alexander Garlen
(74) *Attorney, Agent, or Firm* — Moore & Van Allen PLLC; W. Kevin Ransom

(57) ABSTRACT

Embodiments of the invention are directed to a handheld light assembly including: a housing having a light source; a handle coupled to and extending at a length from the housing and configured to be grasped by a user; a shroud coupled to at least one of the housing or the handle and extending along at least a portion of the length of the handle, the shroud being spaced apart from the handle so as to allow access between the shroud and the handle.

19 Claims, 12 Drawing Sheets

SPOTLIGHT WITH WIND SHROUD

CROSS REFERENCES TO OTHER RELATED APPLICATIONS

This application claims priority from and is a non-provisional patent application of U.S. Provisional Patent Application No. 61/766,018, filed on Feb. 18, 2013, and entitled "Spotlight with Wind Shroud," the contents of which are hereby incorporated by reference in their entirety.

BACKGROUND

When participating in outdoor activities in harsh weather conditions, there is a need to protect one's self from harsh weather conditions as best as possible.

BRIEF SUMMARY

In one aspect, the present invention is directed to a handheld light assembly that includes: a housing that includes a light source; a handle coupled to and extending at a length from the housing and configured to be grasped by a user; and a shroud coupled to at least one of the housing or the handle and extending along at least a portion of the length of the handle, the shroud being spaced apart from the handle so as to allow access between the shroud and the handle.

In some embodiments, the handle defines a width, and the shroud defines a width of at least the width of the handle.

In some embodiments, the handle defines a perimeter, and, the shroud extends partially around the perimeter of the handle.

In some embodiments, the perimeter of the shroud extends at least substantially halfway around the perimeter of the handle.

In some embodiments, the shroud defines a front section and a rear section in relation to the light source.

In some embodiments, the front section defines a stiff surface that is formed from a rigid material.

In some embodiments, the rear section defines a flexible surface so as to allow access between the shroud and the handle, wherein the flexible surface is formed from a flexible material.

In some embodiments, the shroud is permanently coupled with a coupling to at least one of the housing or the handle.

In some embodiments, the coupling is a hinge, an adhesive, a ball bearing joint, a welded seam, or an immovable joint.

In some embodiments, the shroud is detachably coupled to at least one of the housing or the handle.

In some embodiments, the shroud is collapsible.

In some embodiments, the shroud is collapsible into a cavity defined by at least one of the housing or the handle.

In some embodiments, the shroud is mechanized with a motor to collapse into at least one of the housing or the handle.

In some embodiments, the shroud is rotatably coupled to at least one of the housing or the handle, the shroud being rotatable around the handle.

In some embodiments, the shroud is a conic extension from at least one of the housing or the handle.

In some embodiments, the handle defines a proximal portion and a distal portion relative to the housing, wherein the conic extension defines a first perimeter around the proximal portion of the handle and a second perimeter around the distal portion of the handle.

In some embodiments, the first perimeter of the conic extension is less than the second perimeter of the conic extension.

In some embodiments, the handle extends orthogonally from the housing.

In another aspect, the present invention embraces a handheld light assembly that includes: a light source; a housing defining a cavity, wherein the light source is positioned in the cavity, wherein the housing includes a handle portion, the handle portion defining a distal portion and a proximal portion, the proximal portion of the handle portion being positioned between the distal portion and the light source, the handle portion being configured to be grasped by a user; a shroud coupled to the housing and extending along at least a portion of the length of the handle portion, the shroud being spaced apart from the handle portion so as to allow access between the shroud and the handle portion.

In yet another aspect, the present invention embraces a handheld light assembly that includes: a housing including a light source; a handle coupled to and extending at a length from the housing and configured to be grasped by a user, the handle defining a perimeter; a shroud coupled to at least one of the housing or the handle and extending along at least a portion of the length of the handle, the shroud being spaced apart from the handle so as to allow access between the shroud and the handle, the shroud defining a perimeter which extends at least substantially halfway around the perimeter of the handle, the shroud being permanently or detachably coupled to at least one of the housing or the handle, the shroud defining a front section and a rear section in relation to the light source, the front section being rigid and the rear section being flexible as to allow access to the space between the shroud and the handle.

BRIEF DESCRIPTION OF THE DRAWINGS

Figure 1:
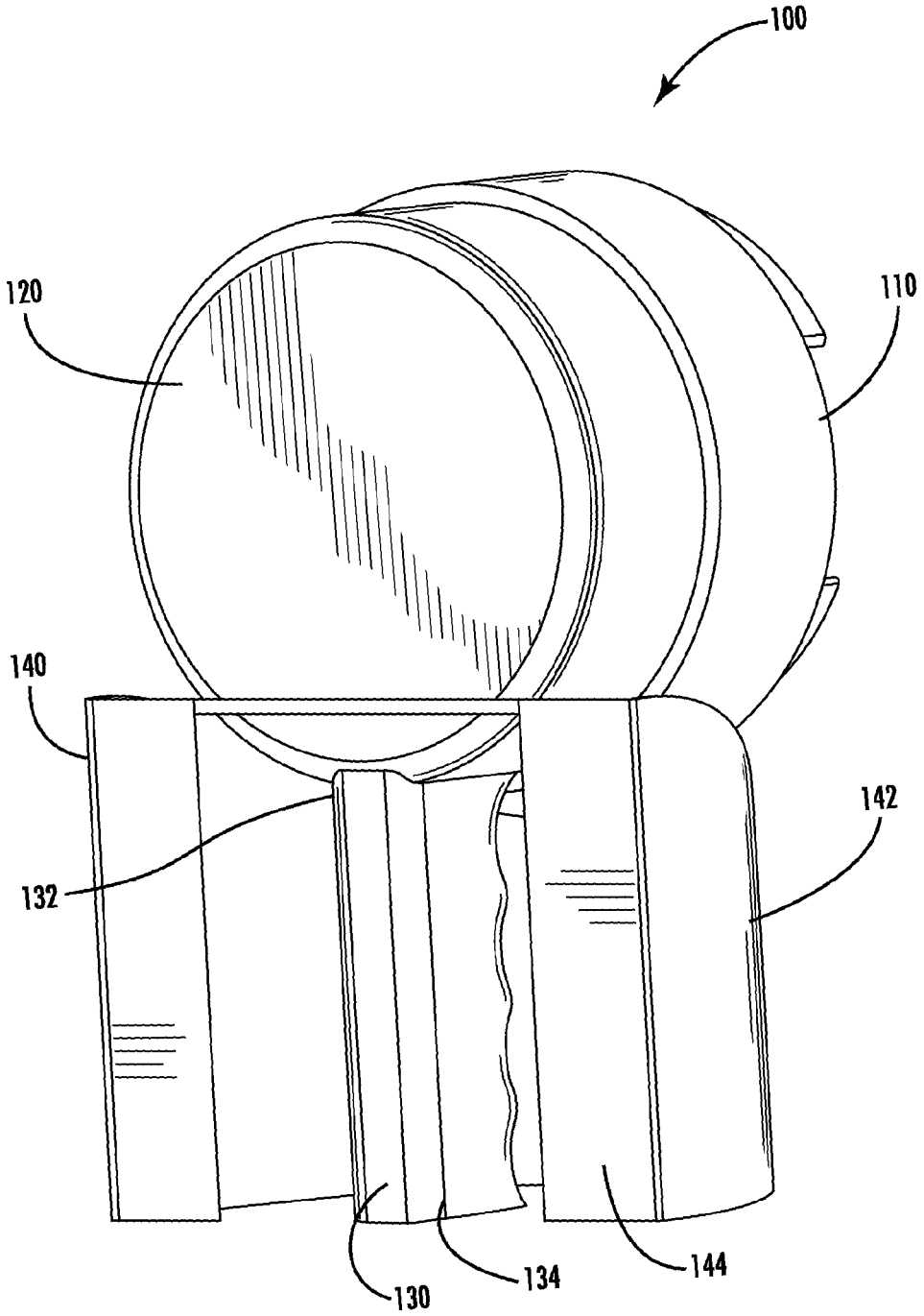
Figure 2:
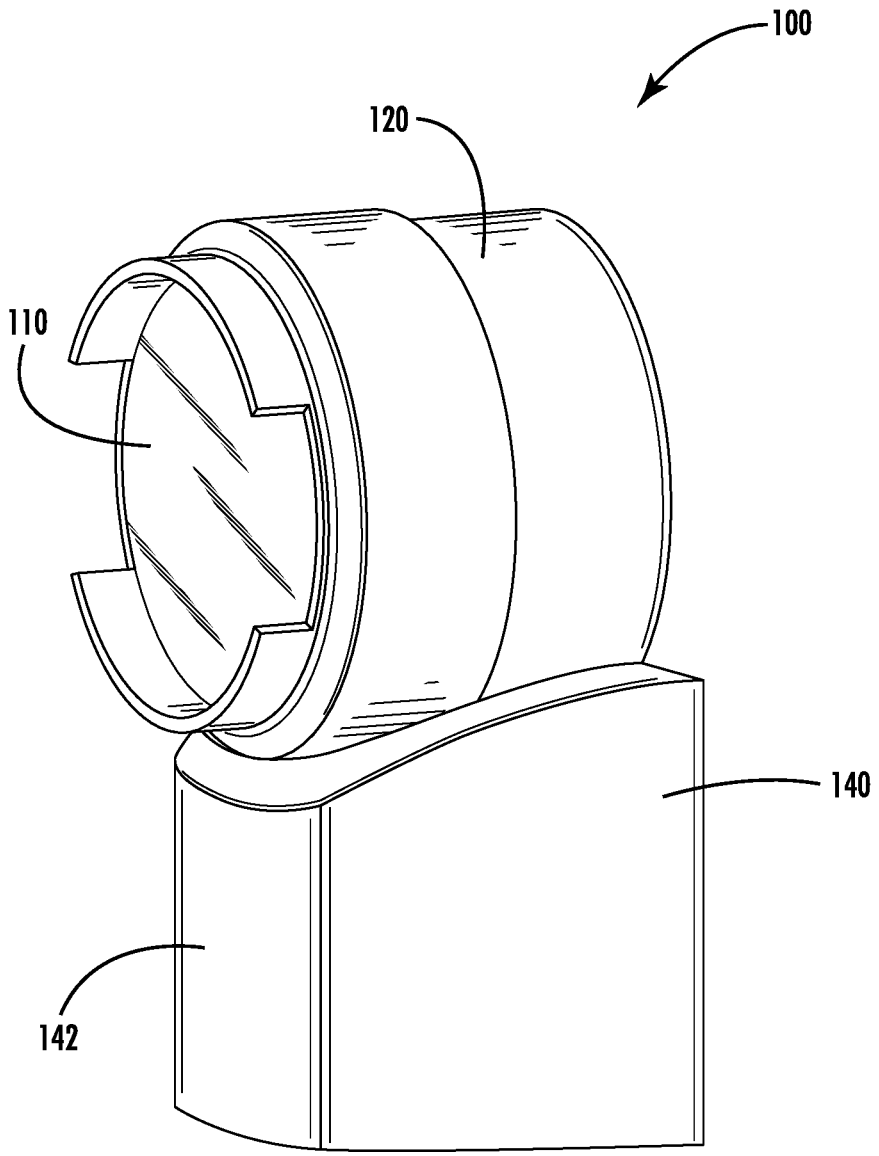
Figure 3:
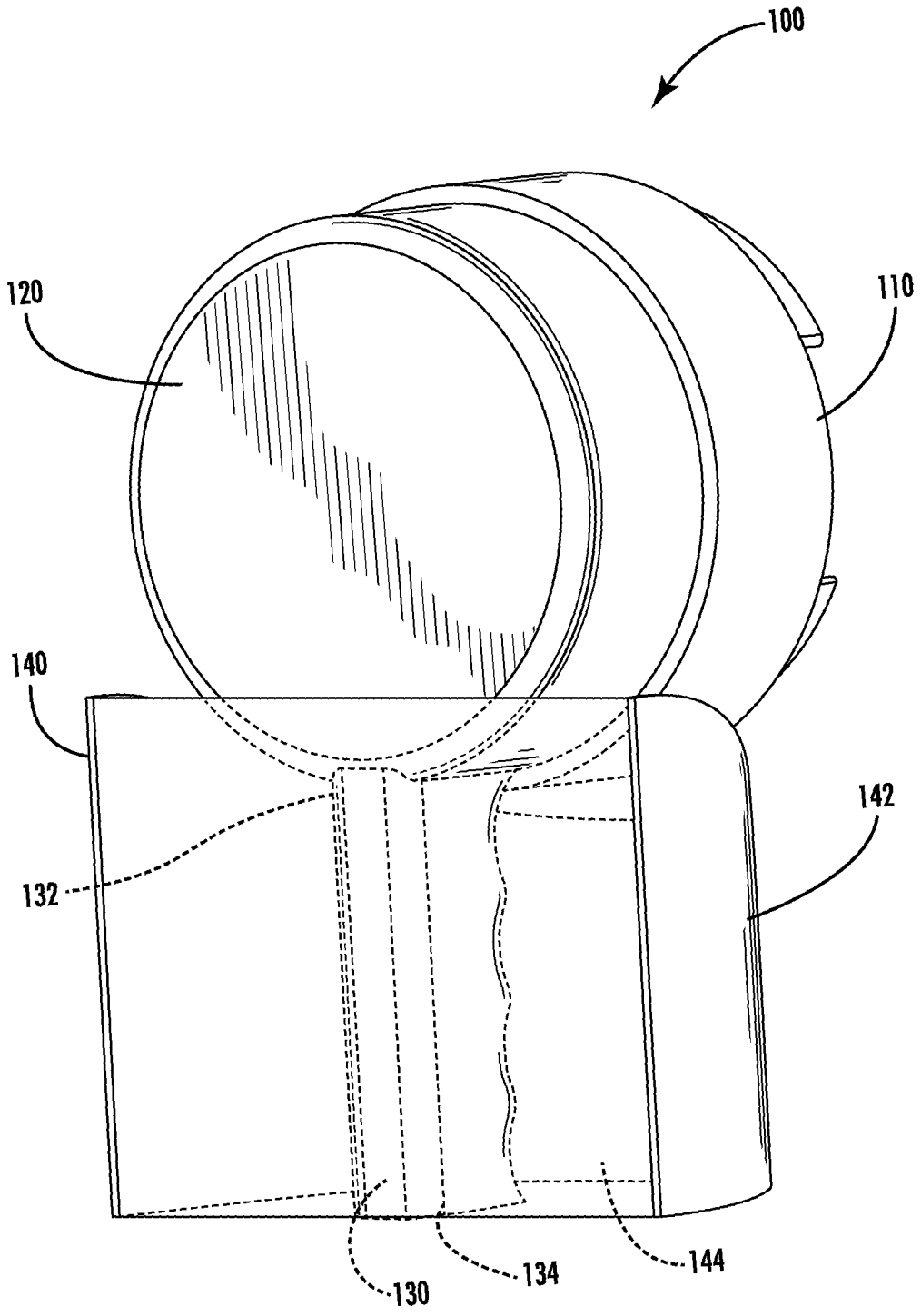
Figure 4:
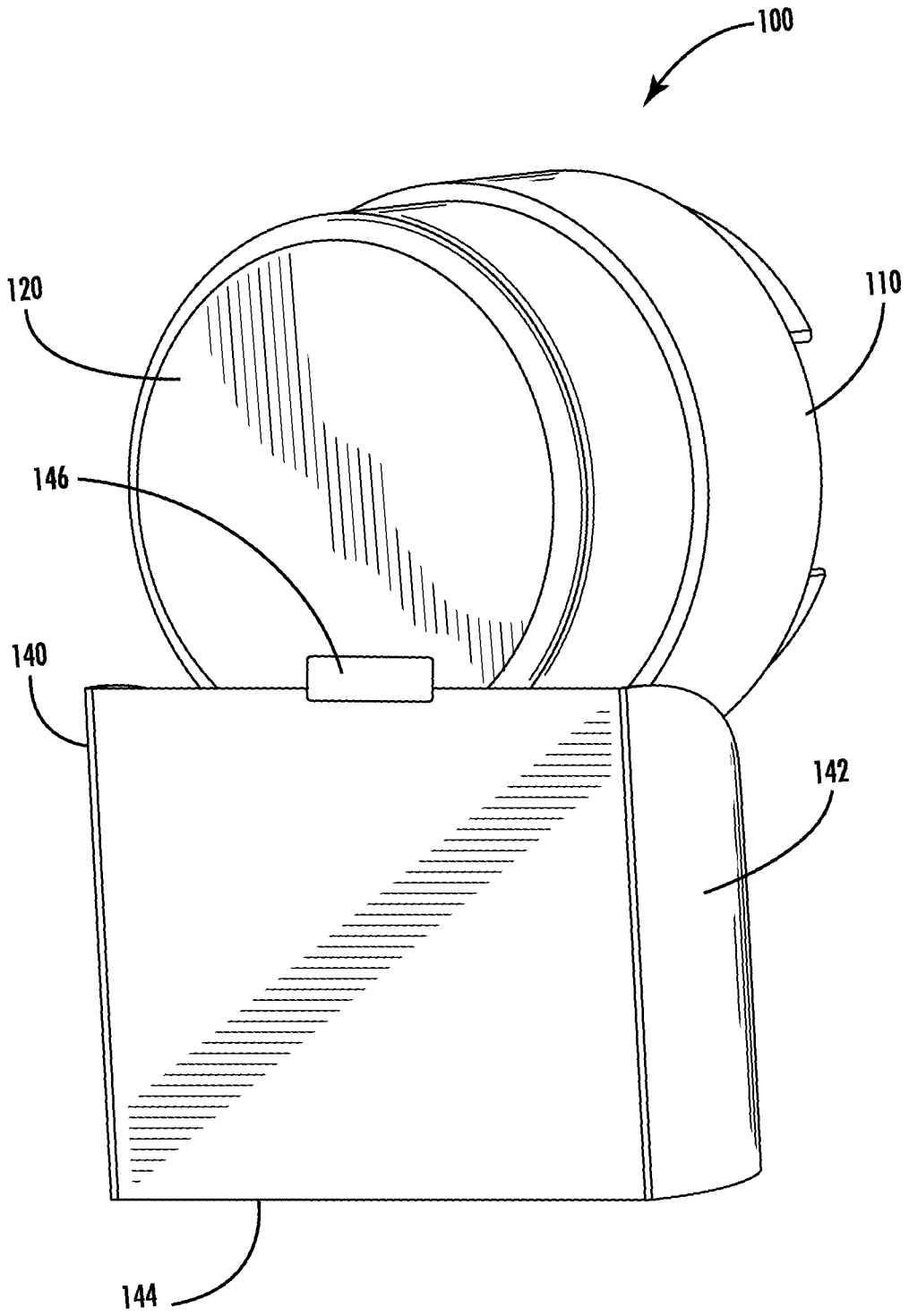
Figure 5:
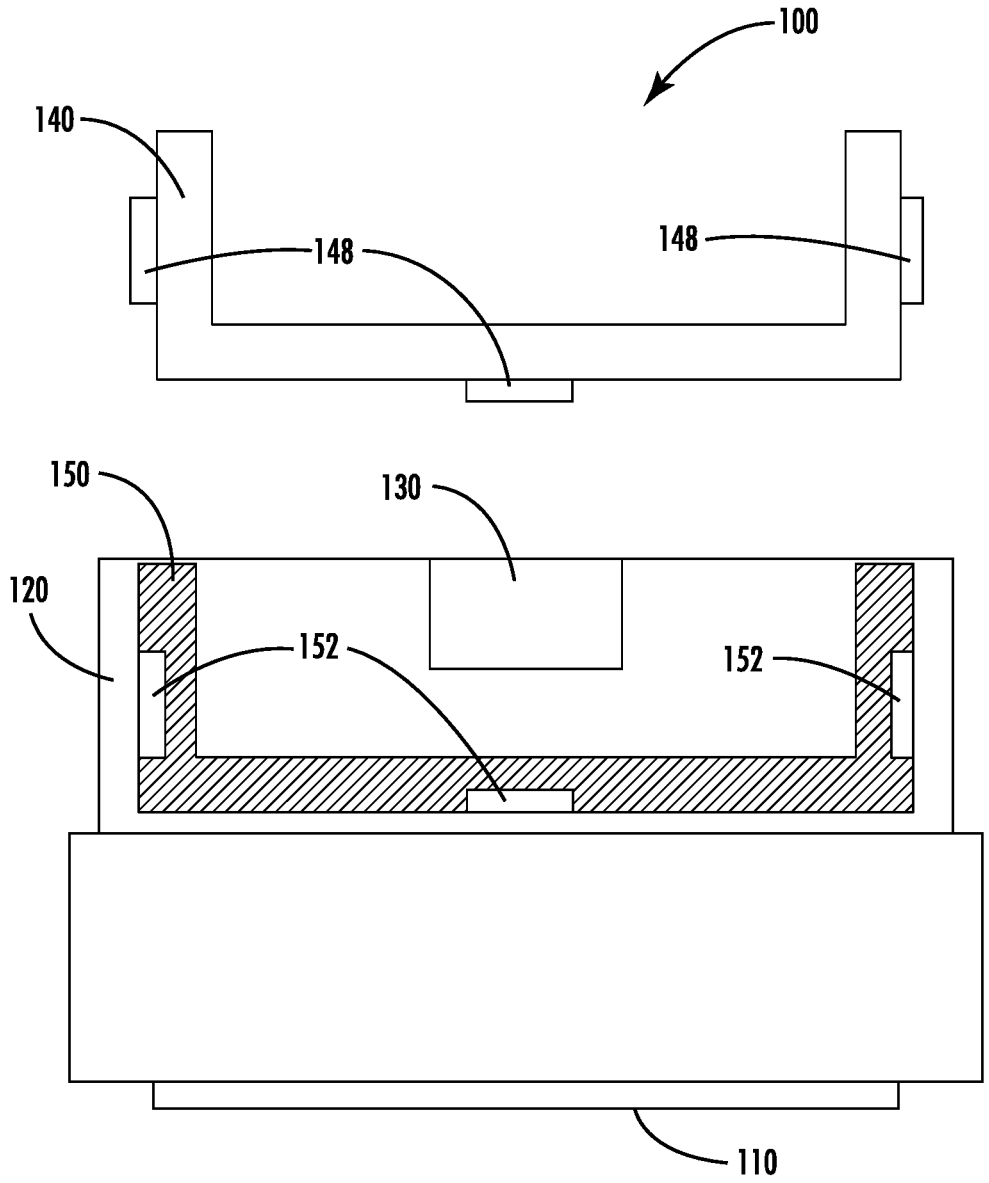
Figure 6:
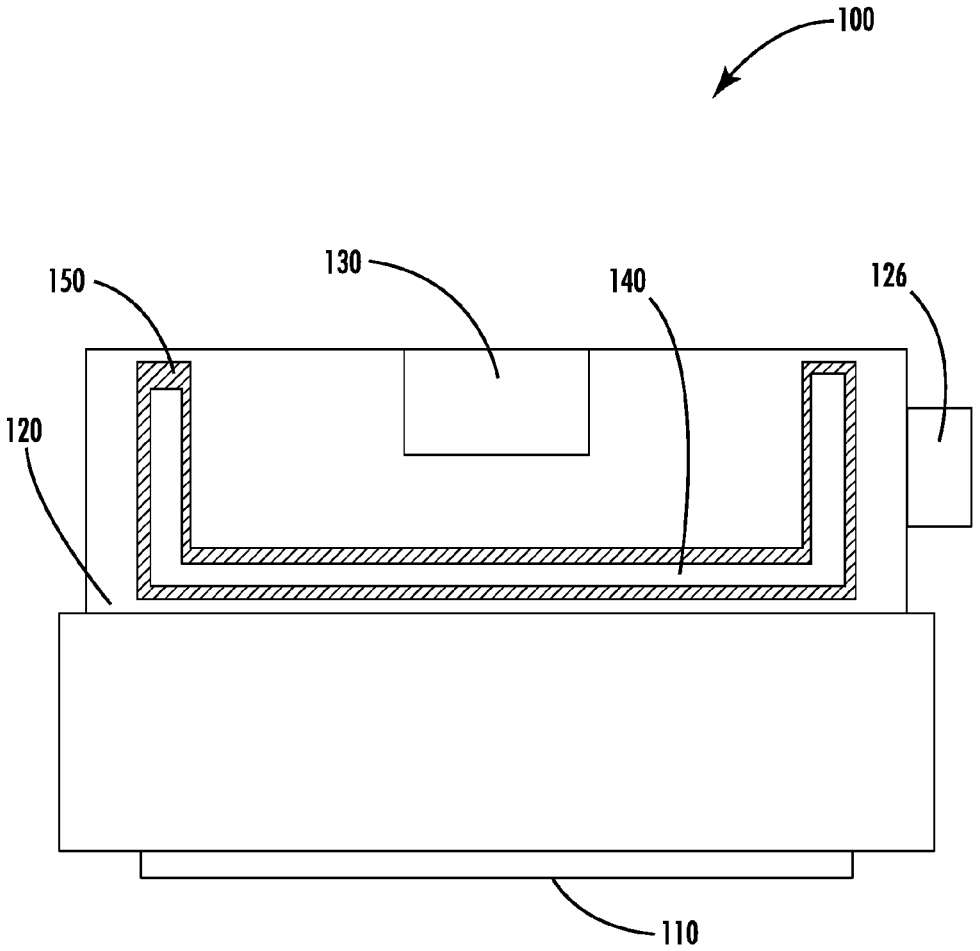
Figure 7:
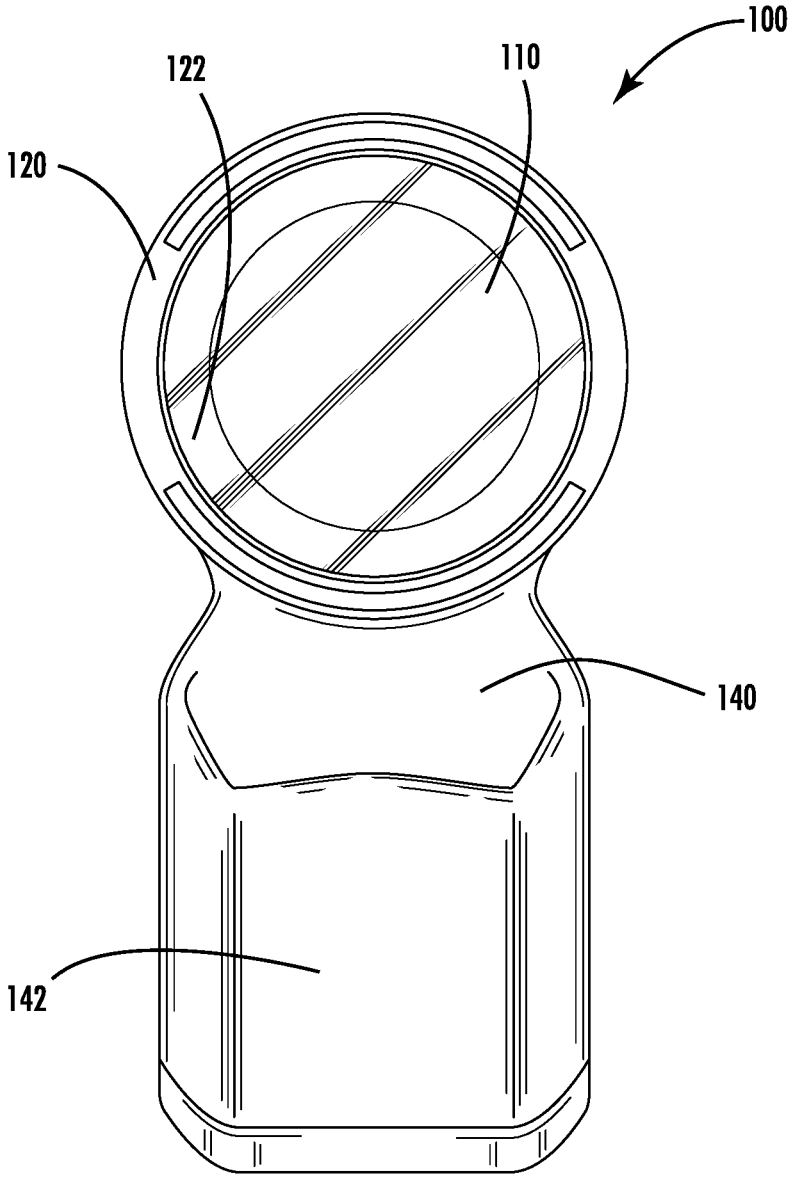
Figure 8:
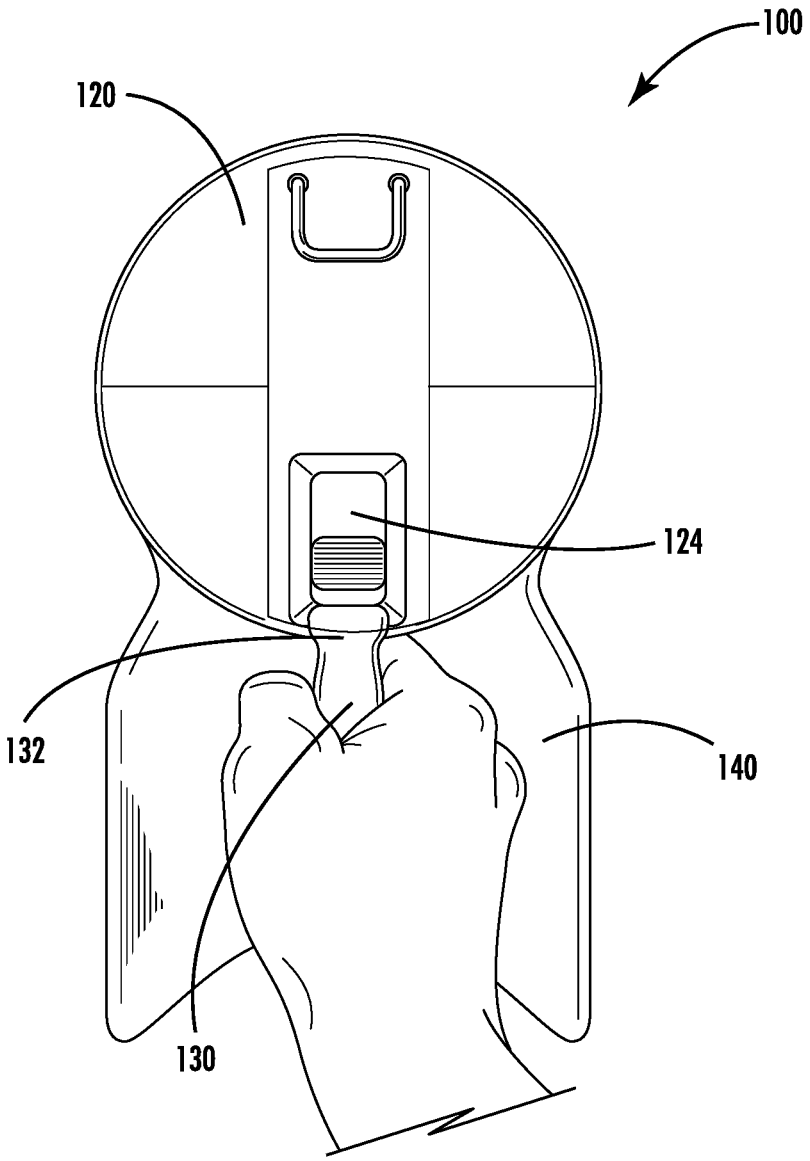
Figure 9:
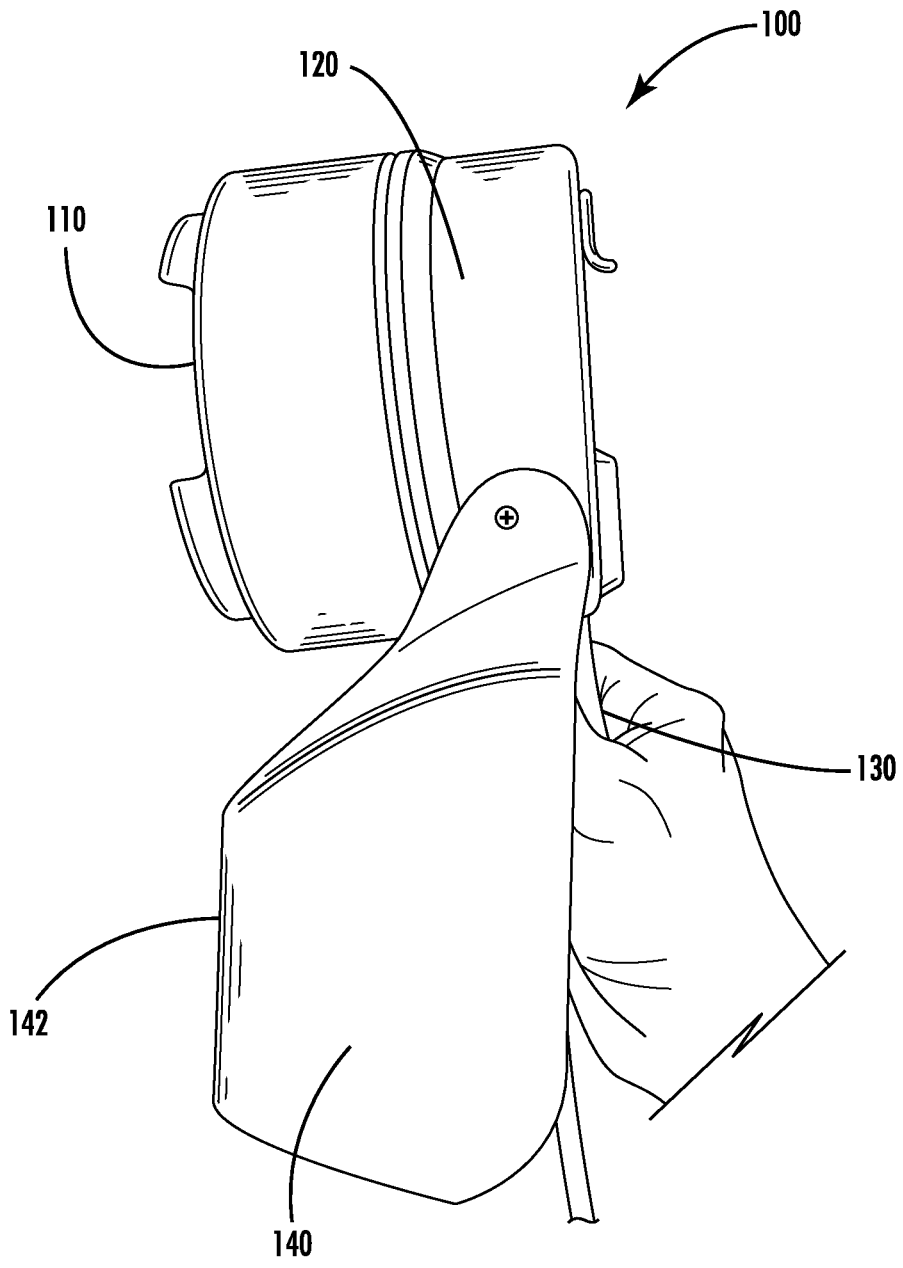
Figure 10:
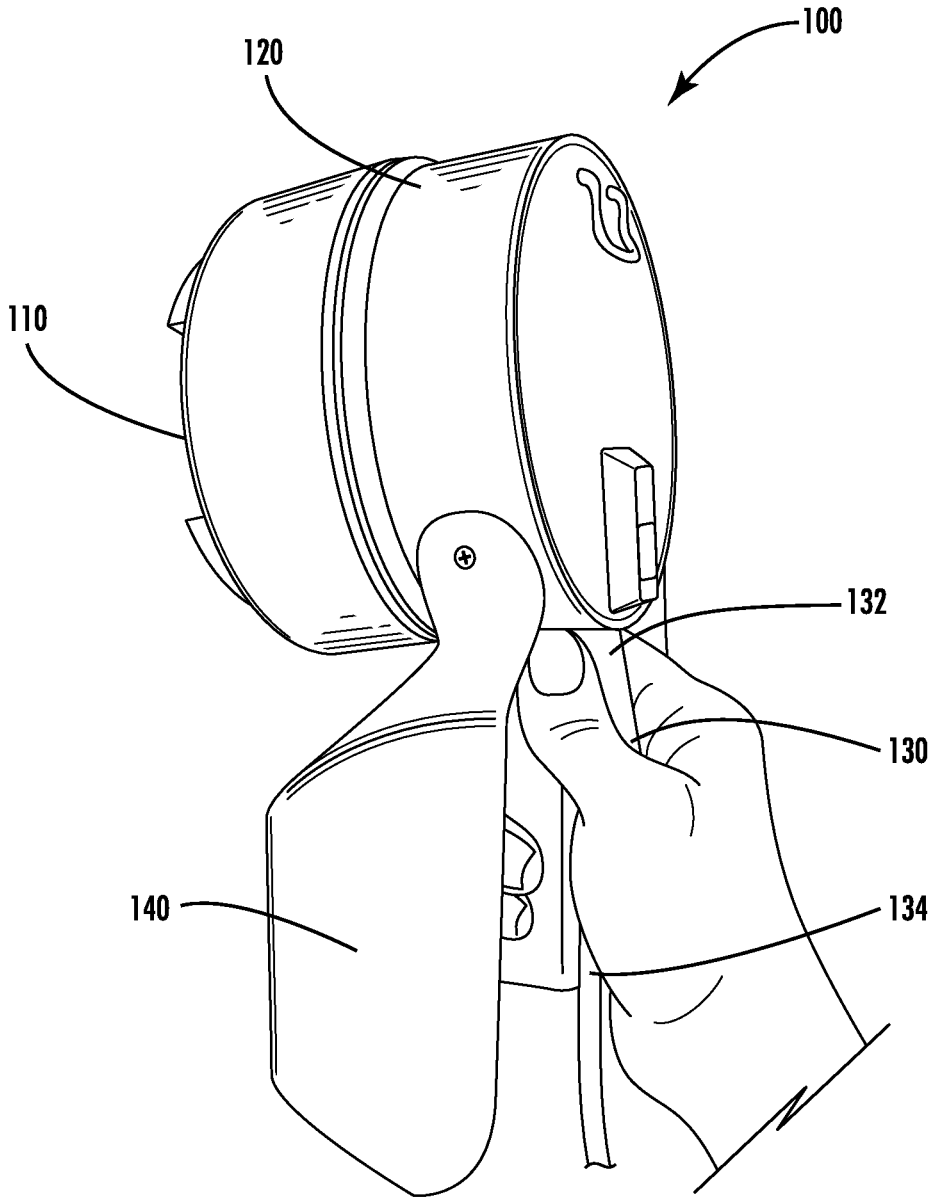
Figure 11:
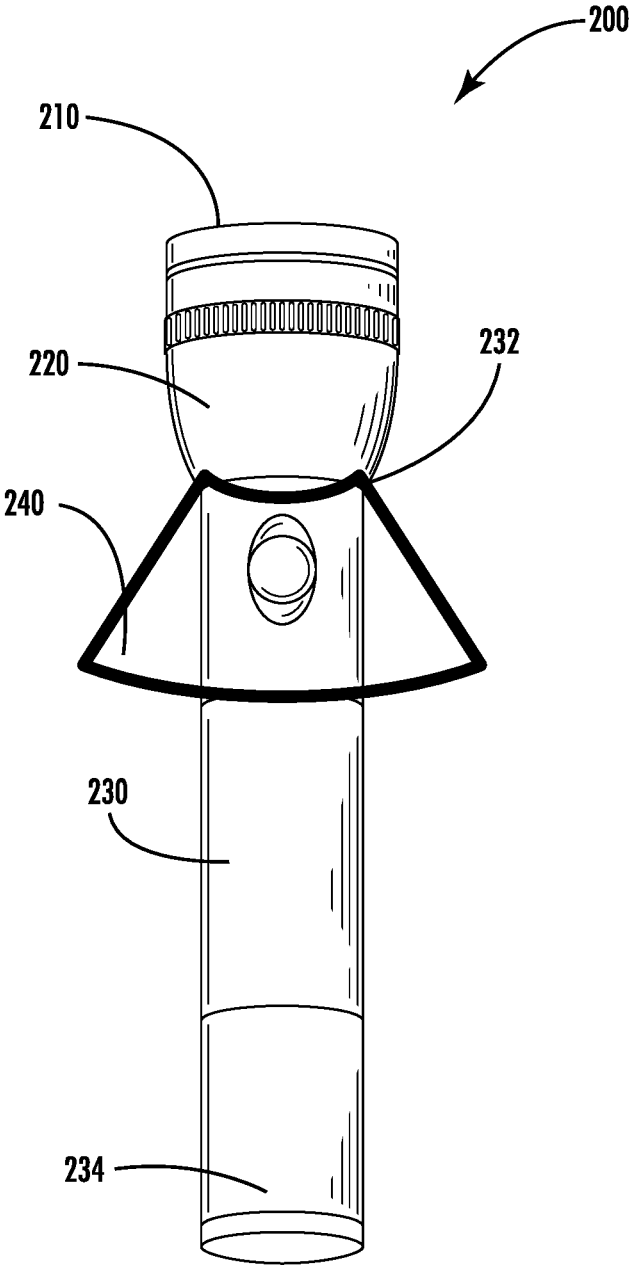
Figure 12:
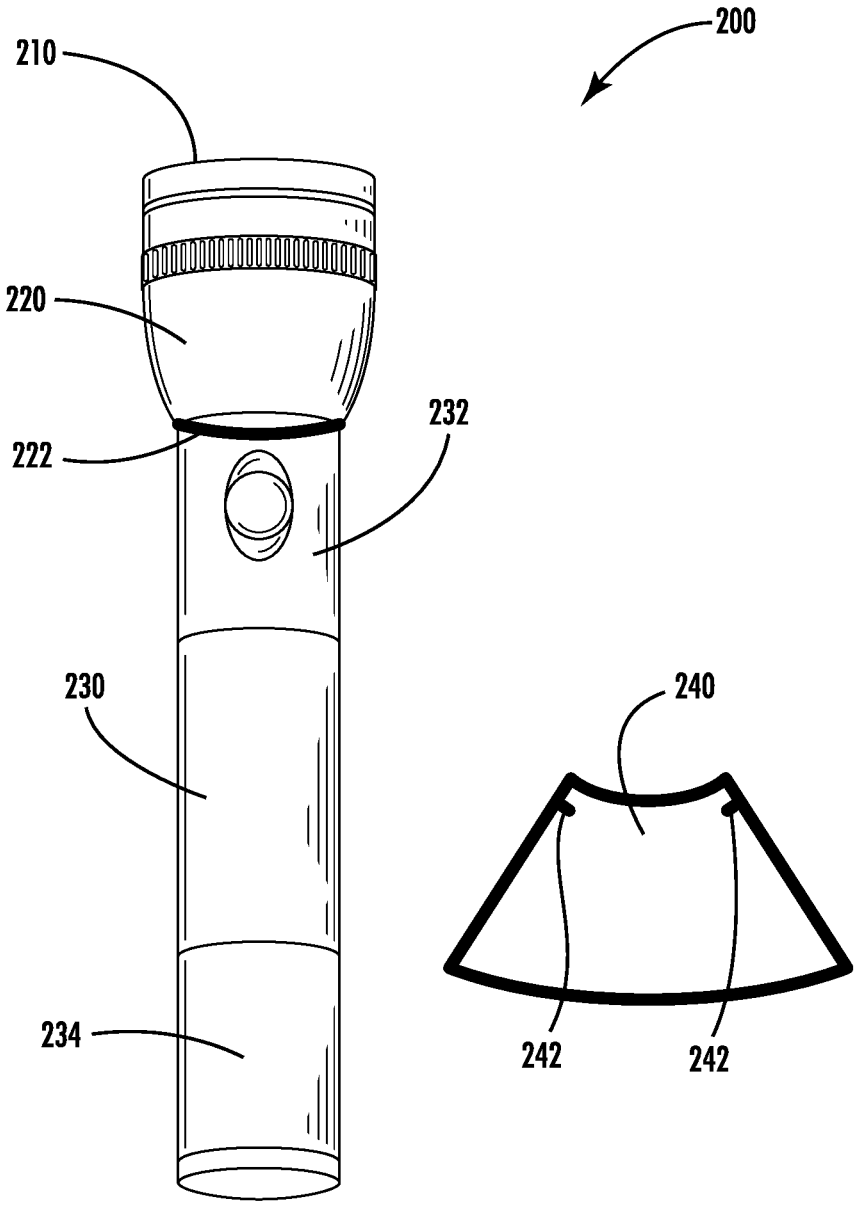

Having thus described embodiments of the invention in general terms, reference will now be made to the accompanying drawings, where:

FIG. 1 depicts a three-dimensional rear view rendering of a prototype for a handheld spotlight with a shroud, in accordance with embodiments of the invention;

FIG. 2 depicts a three-dimensional side view rendering of a prototype for a handheld spotlight with a shroud, in accordance with embodiments of the invention;

FIG. 3 depicts a three-dimensional side view rendering of a prototype for a handheld spotlight with a shroud having a flexible rear section, in accordance with embodiments of the invention;

FIG. 4 depicts a three-dimensional side view rendering of a prototype for a handheld spotlight with a shroud having a movable rear section, in accordance with embodiments of the invention;

FIG. 5 schematically depicts a bottom view of a prototype for a handheld spotlight with a detachable shroud, in accordance with embodiments of the invention;

FIG. 6 schematically depicts a bottom view of a prototype for a handheld spotlight with a collapsible shroud, in accordance with embodiments of the invention;

FIG. 7 photographically depicts a frontal view of a prototype for a handheld spotlight with a shroud, in accordance with embodiments of the invention;

FIG. 8 photographically depicts a rear view of a prototype for a handheld spotlight with a shroud, in accordance with embodiments of the invention;

FIG. 9 photographically depicts a side view of a prototype for a handheld spotlight with a shroud, in accordance with embodiments of the invention;

FIG. 10 photographically depicts a rear side view of a prototype for a handheld spotlight with a shroud, in accordance with embodiments of the invention;

FIG. 11 depicts a cylindrical handheld spotlight with a conic shroud, in accordance with embodiments of the invention; and FIG. 12 depicts a cylindrical handheld spotlight with a detachable conic shroud, in accordance with embodiments of the invention.

DETAILED DESCRIPTION OF EMBODIMENTS OF THE INVENTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

In some embodiments, a "user" as used herein may operate the present invention. The user may be defined as any person interacting with the present invention.

As used herein, a "spotlight" may also refer to a flashlight, a searchlight, or any other type of light assembly. In some embodiments, the spotlight may be a handheld light assembly. In other embodiments, the spotlight may not be a handheld light assembly.

When hunting, fishing, hiking, camping, exploring, or participating in any other type of outdoor activity, the user may be subject to extreme weather conditions. To cope with the harsh conditions of the outdoors, the user may carry along a set of tools with him for aid, protection, safety, or the like throughout the outdoor activity. Included in the set of tools may be a light source such as a spotlight, flashlight, lantern, or the like. The spotlight may serve as a tool to illuminate dark areas, signal to other outdoor activists or rescuers, or the like.

To operate the spotlight, the user may grasp with his hand a handle coupled to the spotlight. In doing so, the user may expose his hand to harsh weather conditions, including low temperatures, wind, rain, snow, sleet, ice, or the like for the entirety of the time that the user is operating the spotlight. If the user is not wearing gloves, mittens, or any other type of hand protection while operating the spotlight, the effects of the harsh weather conditions may be magnified. If the user is operating the spotlight while driving or riding in a moving vehicle, such as a motor vehicle, a boat, a truck, a car, a hovercraft, or the like, the effects of the harsh weather conditions may be magnified further.

Accordingly, in one aspect, the present invention embraces a spotlight that includes a shroud for protecting the user's hand from harsh or extreme weather conditions when operating the spotlight. Specifically, a shroud may be coupled to the spotlight in such a way that it protects the user's hand from harsh weather conditions while operating the spotlight. For example, if the user is riding in a boat at night with cold wind and rain with no gloves (as gloves inhibit operation of the spotlight), the user's hand grasping the spotlight may be protected from the harsh elements by a protective shield or shroud that breaks the wind and rain before it reaches the user's hand.

In accordance with an aspect of the present invention, FIGS. 1 through 10 depict a spotlight 100 (e.g., a handheld light assembly) that includes a light source 110, a housing 120, a handle 130, and a shroud 140. The light source 110 typically includes a power source, a luminous bulb (e.g., an LED, a halogen bulb, an incandescent bulb, or similar light fixture), and an electrical circuit. The power source may include a battery, a solar cell, a thermal conductor, or the like. The electrical circuit may provide a connection between the power source and the light fixture. In some embodiments, a switch trigger, or button may control the connection between the power source and the light fixture. A completed connection may illuminate the light fixture and thus produce a beam of light, while removing the connection may extinguish the light fixture. In some embodiments, the light source may include a protective lens for the light fixture. The protective lens may be glass, plastic, or composite material in a clear, a colored, a filtered, or a polarized style. In some embodiments, the light source may include a protective shield to shield the light fixture from harsh weather conditions, water, or unwanted diffusion of produced light. A small shield is displayed in FIGS. 1 through 10. The protective shield may direct the beam of produced light. The beam of produced light may be variable in width, depth, wavelength, lumens, or strength.

The housing 120 may serve as the body or chassis of the spotlight 100. The housing 120 is typically manufactured from a stiff material, such as a metal, a metal alloy, a plastic, a plastic composite, carbon fiber, a ceramic, or the like. As depicted in FIG. 7, the housing 120 may include a light-source cavity 122 wherein the light-source cavity 122 contains part of or the entire light source 110 and its associated components. The light source 110 is typically coupled (e.g., removably or permanently affixed) to the housing 120 with a coupling. Examples of the coupling may include a clip, a latch, a threaded insert, a lid, a snapping joint, a buckle, a pin, a hinge, a ball bearing joint, a screw, a welded seam, or the like.

The handle 130 is typically coupled to the housing 120 with a coupling. Examples of the coupling may include a hinge, clip, a latch, a threaded insert, a lid, a snapping joint, a buckle, a welded seam, a pin, a hinge, a ball bearing joint, a screw, or the like. More typically, the handle 130 is permanently affixed to the housing 120, as displayed in FIGS. 1 through 6. Alternatively, the handle 130 may be detachably coupled to the housing 120. In some embodiments, the handle 130 may extend orthogonally from the housing 120. An example of a handle 130 extending orthogonally from the housing 120 may be a spotlight used for hunting or fishing. The appearance of an orthogonally extending handle 130 may resemble a pistol grip, a gun handle, a radar gun handle, a megaphone handle, or the like, and is displayed in FIGS. 1 through 10.

The handle 130 may be configured to be grasped by the user. In some embodiments, the designated grasping area on the handle 130 may include a textured surface to ensure a non-sliding grip throughout operation. An example of a textured surface may be include a rough coating on the handle 130 to avoid slipping of the hand during operation. Furthermore, the handle 130 may include grooves or grips for the user's fingers to grasp the handle 130, as depicted in FIG. 1. In some embodiments, the user may be able to operate the spotlight 100 with the hand that grasps the handle 130. Accordingly, the handle 130 may include a switch, a button, or a trigger that controls the light source 110. Alternatively, the housing 120 may include a switch, a button, or a trigger that controls the light source 110. In this regard, FIG. 8 depicts the housing 120 including a light-source switch 124.

The handle 130 typically defines a length, a width, and a perimeter. As depicted in FIGS. 1 through 10, the handle 130 may define a proximal portion 132 and a distal portion 134 relative to the housing 120.

Typically, the shroud 140 is spaced apart from the handle 130 so as to allow access between the handle 130 and the shroud 140. The shroud 140 is typically coupled to at least one of the housing 120 or the handle 130 with a coupling. Examples of the coupling may include a clip, a latch, a threaded insert, a lid, a snapping connector, a buckle, a welded seam, an adhesive material, a pin, a hinge, a ball bearing joint, a screw, or the like. In some embodiments, the shroud 140 may be permanently coupled to the housing 120 with the coupling, as depicted in FIG. 1. In other embodiments, the shroud 140 may be detachably coupled to at least one of the housing 120 or the handle 130. For example, FIG. 5 depicts the shroud 140 being detachably coupled to the housing 120 with a snapping connector. As depicted in FIG. 5, the housing 120 may include a cavity 150 having protrusions 152 (e.g., lips). The shroud 140 may include protrusions 148 that correspond to the protrusions 152 in the cavity 150 of the housing. These protrusions typically have a length of between about 5 and 10 millimeters, a width of between about 1 and 5 millimeters, and a thickness of between about 1 and 5 millimeters. To form a snap fit, the shroud 140 is pushed into the cavity 150 with sufficient force to mate the protrusions 148 of the shroud with the protrusions 152 in the cavity 150. A sufficient pulling force may then be used to detach the shroud 140 from the housing 120.

The shroud 140 typically defines a length, a width, and a perimeter. The length of the shroud 140 may extend along at least a portion of the length of the handle 130. Typically, the width of the shroud 140 may be at least the width of the handle 130. Moreover, the perimeter of the shroud 140 may extend partially around the perimeter of the handle 130 (e.g., as depicted in FIGS. 1 through 2 and 7 through 10). In some embodiments, the perimeter of the shroud 140 may extend at least substantially halfway around the perimeter of the handle 130, as depicted in FIGS. 1 through 10. In some particular embodiments, the perimeter of the shroud may extend entirely around the perimeter of the handle (e.g., as depicted in FIG. 3 through 4).

As displayed in FIG. 1, the shroud 140 may define a front section 142 and a rear section 144 in relation to the light source 110. In some embodiments, the front section 142 may define a stiff surface, wherein the stiff surface is formed from a rigid material. The rigid material may be manufactured from at least one of a metal, a metal alloy, a plastic, a composite material, carbon fiber, or the like. In some embodiments, the rear section 144 may define a flexible surface so as to allow access between the handle 130 and the shroud 140, wherein the flexible surface is formed from a flexible material. This is depicted in FIG. 3, wherein the transparent surface represents a flexible material. Exemplary flexible materials include cotton fabric, synthetic fabric, leather, a mesh, or the like, or combinations thereof. In other embodiments, the rear section 144 may be formed from a rigid material that is movably attached to the housing 120 to allow access to the handle 130. For example, FIG. 4 depicts the rear section 144 being movably attached to the housing 120 with a hinge 146. As depicted in FIGS. 3 through 4, the rear section 144 may help to facilitate the shroud 140 entirely surrounding the handle 130. Alternatively, as depicted in FIG. 1 the shroud 140 may include a rear section 144 but may not entirely surround the handle 130. In further embodiments, the shroud 140 may not include a rear section 144, as depicted in FIGS. 8 through 10.

In some embodiments, the shroud 140 may be collapsible. In this regard, at least one of the housing 120 or the handle 130 may include a cavity 150 into which the shroud 140 may collapse and be stored, as depicted in FIG. 6. In some embodiments, the shroud 140 may be mechanized to collapse into the cavity 150. For example, the spotlight 100 may include a motor 126 for retracting the shroud 140 into the cavity 150 and extending the shroud from the cavity 150.

In another embodiment of the invention, FIGS. 11 and 12 depicts a cylindrical handheld spotlight 200 that includes a light source 210, a housing 220, and a shroud 240.

The light source 210 typically includes a power source, a luminous bulb (e.g., an LED, a halogen bulb, an incandescent bulb, or similar light fixture), and an electrical circuit. The power source may include a battery, a solar cell, a thermal conductor, or the like. The electrical circuit may provide a connection between the power source and the light fixture. In some embodiments, a switch trigger, or button may control the connection between the power source and the light fixture. A completed connection may illuminate the light fixture and thus produce a beam of light, while removing the connection may extinguish the light fixture. In some embodiments, the light source may include a protective lens for the light fixture. The protective lens may be glass, plastic, or composite material in a clear, a colored, a filtered, or a polarized style. In some embodiments, the light source may include a protective shield to shield the light fixture from harsh weather conditions, water, or unwanted diffusion of produced light. The protective shield may direct the beam of produced light. The beam of produced light may be variable in width, depth, wavelength, brightness, or strength.

The housing 220 may serve as the body or chassis of the spotlight 200. The housing 220 is typically manufactured from a stiff material, such as a metal, a metal alloy, a plastic, a plastic composite, carbon fiber, a ceramic, or the like. The housing 220 typically includes a cavity wherein the cavity contains part of or the entire light source 210 and its associated components. The light source 210 is typically coupled to the housing 220 with a coupling. Examples of the coupling may include a clip, a latch, a threaded insert, a lid, a snapping joint, a buckle, a pin, a hinge, a ball bearing joint, a screw, a welded seam, or the like. Typically, the light source 210 is permanently affixed to the housing 220, as displayed in FIGS. 11 and 12. In some embodiments, the light source 210 may be detachably coupled to the housing 220.

The housing 220 typically defines a handle portion 230. For example, the handle portion 230 may be an extension of the housing 220, similar to a standard cylindrical flashlight, and is depicted in FIGS. 11 and 12. Thus, the housing 220 may include the handle portion 230. In alternative embodiments, the handle portion 230 may be detachably coupled to the housing 220.

The handle portion 230 may be configured to be grasped by the user. In some embodiments, the designated grasping area on the handle portion 230 may include a textured surface to ensure a non-sliding grip throughout operation. An example of a textured surface may include a rough coating on the handle portion 230 to avoid slipping of the hand during operation. In some embodiments, the handle portion 230 may include grooves or grips for the user's fingers to grasp the handle portion 230. In some embodiments, the handle portion 230 may include a switch, a button, or a trigger that controls the light source 210. Thus, the user may be enabled to operate the spotlight 200 with the hand that grasps the handle 230.

The shroud 240 typically defines a length, a width, or a perimeter. The length of the shroud 240 may extend along at least a portion of the length of the handle 230. Typically, the width of the shroud 240 may be at least the width of the handle 230. Moreover, the perimeter of the shroud 240 may extend partially around the perimeter of the handle 230. As depicted in FIG. 11, the perimeter of the shroud 240 may extend entirely around the perimeter of the handle 230.

As further depicted in FIGS. 11 and 12, the shroud 240 may define a conic extension from at least one of the housing 220 or the handle 230. The conic extension may define a first perimeter around the proximal portion 232 of the handle 230 and a second perimeter around the distal portion 234 of the handle 230, wherein the first perimeter of the conic extension is less than the second perimeter of the conic extension. Typically, the proximal portion 232 of the handle 230 may be positioned between the distal portion 234 of the handle 230 and the light source 210.

In some embodiments, the shroud 240 may be rotatably coupled to the housing 220. Furthermore, in some embodiments the shroud 240 may be detachably coupled to the housing 220. In this regard, the housing 220 may include a cavity 222 (e.g., a groove) around its perimeter as depicted in FIG. 12. The shroud 240 may include a lip 242 that corresponds with the cavity 222 of the housing. To form a snap fit, the shroud 240 may be pushed into the cavity 222 with sufficient force to mate the lip 242 of the shroud 240 with the cavity 222. A sufficient pulling force may then be used to detach the shroud 240 from the housing 220. The shroud 240 may be rotatable when it is coupled to the cavity 222 (e.g., rotatable around the perimeter of the perimeter of the housing).

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

What is claimed is:

1. A handheld light assembly comprising:

a housing comprising a light source;

a handle coupled to and extending at a length from said housing, said handle defined by a proximal end connected to the housing and a distal end extending from the housing, said handle comprising a section between the proximal and distal end and is adjacent the distal end and configured to be grasped by a user;

a shroud coupled to at least one of said housing or said handle, said shroud comprising a first shroud portion that is offset laterally from said handle and extends along the length of the handle, wherein the first shroud portion is parallel to the handle and extends a distance along the housing at least to the distal end of the handle, said shroud comprises a second shroud portion comprising a proximal end connected to the proximal end of the handle, wherein said second shroud portion extends orthogonally from said handle to a distal end, wherein said first shroud portion is connected to the distal end of said second shroud portion and extends along the length of the handle, said shroud being spaced apart from said handle so as to allow access between said shroud and said handle.

2. The assembly of claim 1, wherein said handle defines a width, said shroud defining a width of at least the width of said handle.

3. The assembly of claim 1, wherein said handle defines a perimeter, said shroud extends partially around the perimeter of said handle.

4. The assembly of claim 3, wherein the perimeter of said shroud extending at least substantially halfway around the perimeter of said handle.

5. The assembly of claim 1, wherein said shroud defines a front section and a rear section in relation to the light source.

6. The assembly of claim 5, wherein said front section defines a stiff surface, the stiff surface being formed from a rigid material.

7. The assembly of claim 5, wherein said rear section defines a flexible surface so as to allow access between said shroud and said handle, wherein the flexible surface is formed from a flexible material.

8. The assembly of claim 1, wherein said shroud is permanently coupled with a coupling to at least one of said housing or said handle.

9. The assembly of claim 8, wherein said coupling is a hinge, an adhesive, a ball bearing joint, a welded seam, or an immovable joint.

10. The assembly of claim 1, wherein said shroud is detachably coupled to at least one of said housing or said handle.

11. The assembly of claim 1, wherein said shroud is collapsible.

12. The assembly of claim 11, wherein said shroud is collapsible into a cavity defined by at least one of said housing or said handle.

13. The assembly of claim 11, wherein said shroud is mechanized with a motor to collapse into at least one of said housing or said handle.

14. The assembly of claim 1, wherein said shroud is rotatably coupled to at least one of said housing or said handle, said shroud being rotatable around said handle.

15. The assembly of claim 1, wherein said shroud is a conic extension from at least one of said housing or said handle.

16. The assembly of claim 15, wherein said conic extension defines a first perimeter around the proximal end of said handle and a second perimeter around the distal end of said handle.

17. The assembly of claim 16, wherein the first perimeter of said conic extension is less than the second perimeter of said conic extension.

18. The assembly of claim 1, wherein said handle extends orthogonally from said housing.

19. The assembly of claim 1, wherein said handle defines a perimeter and said shroud defines a perimeter which extends halfway around the perimeter of the handle, with the remaining perimeter of said handle not covered by said shroud.

* * * * *